US005487238A

United States Patent [19]

Eikmeier et al.

[11] Patent Number: 5,487,238

[45] Date of Patent: Jan. 30, 1996

[54] DEVICE FOR OPENING AND CLOSING A WINDOW, A DOOR, OR THE LIKE

[75] Inventors: Werner Eikmeier, Erkrath; Dietger Frick; Werner Riedel, both of Velbert, all of Germany

[73] Assignee: Wilhelm Weidtmann GmbH & Co. KG, Velbert, Germany

[21] Appl. No.: 337,680

[22] Filed: Nov. 10, 1994

[30] Foreign Application Priority Data

Apr. 2, 1994 [DE] Germany ..... 44 11 638.1

[51] Int. Cl.[6] ..... E05F 11/02

[52] U.S. Cl. ..... 49/300; 49/279

[58] Field of Search ..... 49/279, 300, 280, 49/82.1

[56] References Cited

U.S. PATENT DOCUMENTS

| | | | |
|---|---|---|---|
| 1,671,362 | 5/1928 | Fraser | 49/82.1 X |
| 1,748,662 | 2/1930 | Stewart | 49/279 |
| 5,152,103 | 10/1992 | Tucker et al. | 49/279 |

*Primary Examiner*—Philip C. Kannan
*Attorney, Agent, or Firm*—McAulay Fisher Nissen Goldberg & Kiel

[57] ABSTRACT

In a device for opening and closing a window, a casement is moved between a closed and open position with respect to a stationary frame. This is done by a longitudinally displaceable toothed rack, which transfers the longitudinal movement into a movement of the casement by a hinge rod. In order to obtain a device which is easy to operate, it is proposed that in addition to the first toothed rack cooperating with the casement, a second toothed rack is provided in the frame which changes closing elements located on the frame between a latched position holding the casement and an unlatched position releasing the casement, by a closing rod. Although both toothed racks are longitudinally displaced by the same actuating element, as a rule only one of the two toothed racks is coupled to the actuating means while the other is uncoupled and stationary. The currently coupled toothed rack uncouples itself automatically after a specific distance of travel and the final phase of its longitudinal displacement is used to couple the other toothed rack to the actuating element.

19 Claims, 6 Drawing Sheets

60
61
63
62
34
26
23'
38
30
29
20
22
21
29'
36
27
23

35
23'
23
21
26
22
20
37
38

65'
65
XII
23
26
26'
27
29'
X

DEVICE FOR OPENING AND CLOSING A WINDOW, A DOOR, OR THE LIKE

BACKGROUND OF THE INVENTION a) Field of the Invention

The invention is directed towards a device for opening or closing a window, door or the like. The device moves a window casement between a closed and an open position with respect to a stationary window frame by means of a longitudinally displaceable toothed rack. In order to do this, an actuating means is attached to the frame, which is provided with a pinion rotatably mounted in the frame. The pinion engages with the toothed rack and can be rotary actuated, for example, by a crank handle.

b) Description of the Related Art

In the known device of this type (U.S. Pat. No. 1,671,362), the actuating means is always coupled in a fixed manner to the toothed rack, as a result of which each rotary actuation of the pinion leads to a movement of the casement. To ensure the closed position of the casement, at least one pair of closing elements with mutually complementary closing elements has to be arranged between the casement and the frame. An additional handle is necessary to transfer the moveable closing elements of these pairs from their latched position, in which they keep the casement in the frame, into an unlatched position, in which the casement is released. An additional space on the casement or on the frame is required for this handle. As the rotary actuation of the driving pinion must be carried out to coincide with the actuation of the handle, the manipulation of this known device was awkward. Faulty operation could occur, leading to damage to the components.

In a device of another type (DE-OS 41 09 852) a lever perpendicular to the plane of the frame of the window frame is pivoted by means of a crank mechanism to move the casement, and the lever is connected to the window casement in an articulated manner by means of a connecting rod. A rod for moving the pairs of closing elements is arranged in the casement and connected to the connecting rod. The moveable closing elements of these pairs of closing elements are arranged on the casement, while the associated stationary closing elements are located on the window frame. Although the closing elements on the casement side are also moved between their latched and unlatched positions by means of the crank mechanism, this changing-over is done by means of the connecting rod, that is to say the same member used for moving the casement between its open and closed position. The rod for moving the closing elements is arranged in line with the members used for moving the casement, that is the pivoting lever and the connecting rod. In order to eliminate faulty operation, the rod for moving the closing elements in the casement must be blocked by a stop, for which space on the casement is needed. When the casement comes into contact with the frame the stop is rendered inoperative. This necessitates additional manufacturing and assembly costs.

OBJECT AND SUMMARY OF THE INVENTION

The primary object of the invention is to develop a device of the above type, in which the movement of the casement and the movement of the closing rod can be carried out reliably and comfortably. This is achieved according to the features of the invention of which the following are of particular importance.

In the invention the changing over of the closing elements from their latched to their unlatched position is carried out by the same actuating means as for the movement of the casement. However, in the invention two different toothed racks are used for the two functions, one of which is connected to the casement and the other to the closing rod. Depending on whether the casement moves or whether the closing rod has to be moved, the respective relevant toothed rack is coupled to the actuating means, while the other is uncoupled and stationary. Overlapping of these two functions may occur, as a result of which in an intermediate phase both toothed racks are simultaneously longitudinally displaced by the actuating means. The driving paths split from the common actuating means onwards into two branches with separate toothed racks, only one branch of which is selectively effective. The uncoupling of the toothed rack currently coupled to the actuating means is done automatically. For this, a defined distance of travel of the toothed rack concerned can be made use of. This can be easily created by the toothed rack having a tooth gap opposite the actuating means at this travel distance. Finally, according to the invention, the final phase of displacement of the rack is used to transfer the other toothed rack into a position for coupling to the actuating means. This results in an automatic changing over of the device according to the invention between its two functions, namely, movement of the casement on the one hand and actuation of the closing rod on the other hand.

For both functions, the operator only has to actuate a single actuating means in the same direction of rotation and does not have to worry about changing over the device from one to the other of the two functions. The device according to the invention itself ensures that the correct one of the two toothed racks is actuated. Thus, when the casement is closed, the casement is firstly moved by means of the first toothed rack, while the second toothed rack is stationary. If the actuating means is rotated further, changing over occurs automatically, the second toothed rack engages with the actuating means and the closing rod is moved. During this change-over the uncoupling toothed rack, as already mentioned, in it, s final phase has an effect on the other toothed rack in order to couple it to the actuating means. The two toothed racks thus alternately carry out changing-over movements, which result in the coupling of their adjacent toothed rack. Because of this, faulty operation is prevented.

Further measures and advantages of the invention can be seen from the further claims, the description and the drawings. An embodiment of the invention is shown in the drawings.

DESCRIPTION OF THE PREFERRED EMBODIMENTS

Figure 1:
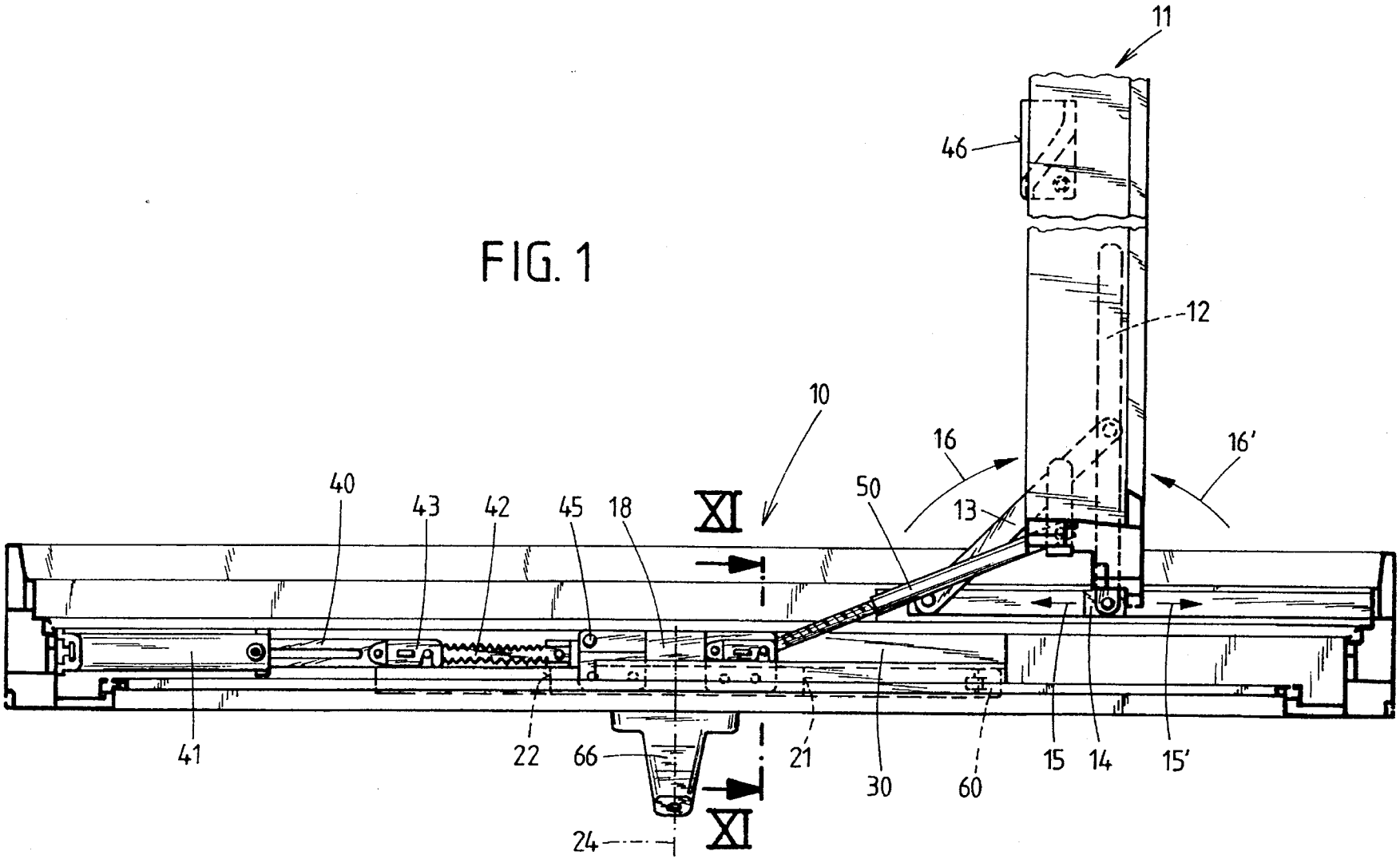
FIG. 1 illustrates a horizontal section through the lower part of the window frame and of the casement with the device according to the invention, when the casement is in its open position.
Figure 13:
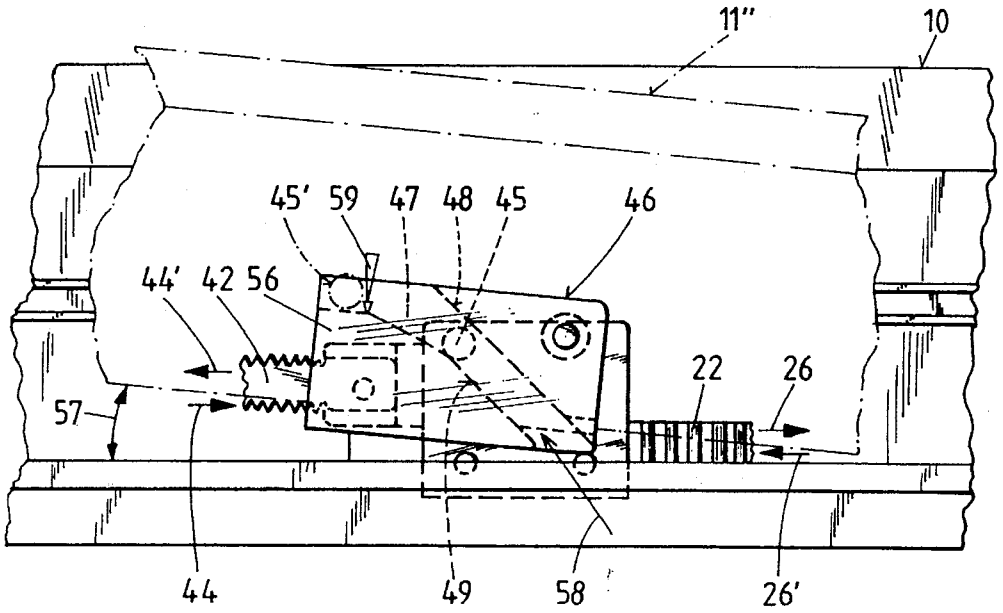
FIG. 13 illustrates a plan view of a part of the device according to the invention, when the casement is in a so-called "ventilation gap position", which, proceeding from the open position shown in FIG. 1, occurs shortly before reaching the completely closed position shown in FIG. 2.
Figure 2:
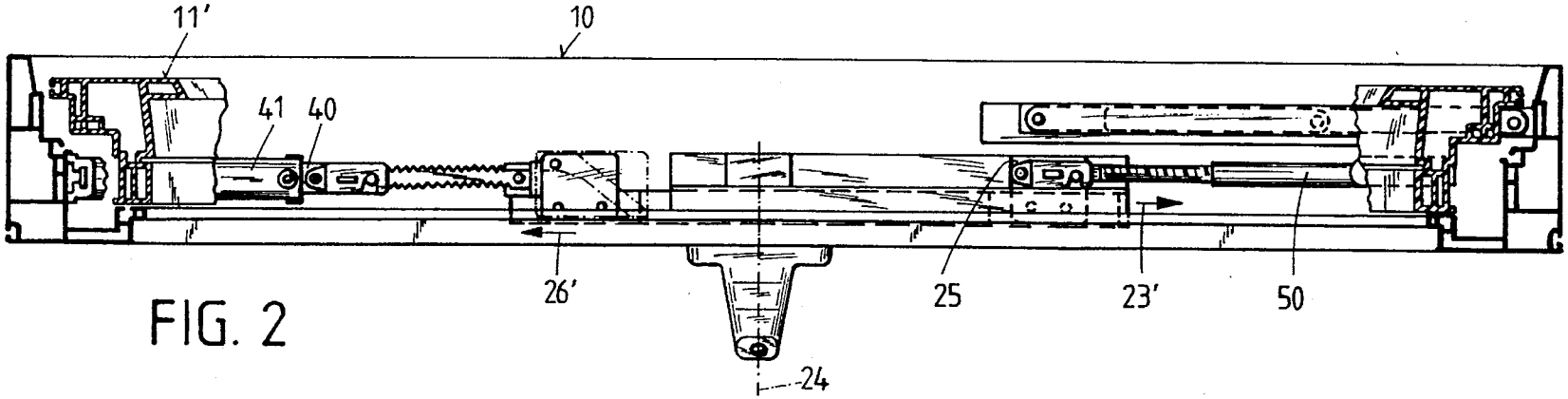
FIG. 2 illustrates a representation according to FIG. 1 showing the corresponding relationships when the casement is in its closed position with respect to the window frame.

The device is shown in FIGS. 1 and 2 in an installed state in a window. The window is composed of a stationary frame 10 and a casement 11 moveable with respect thereto, which is moveable between an open position 11 shown in FIG. 1 and a closed position 11' shown in FIG. 2 by means of the device. Shortly before reaching the closed position 11' shown in FIG. 2, a so-called ventilation gap position 11" can also be obtained with this device, which is shown in FIG. 13 and will be described later in more detail. The casement 11 is connected to the frame 10 by means of the hinge parts 13 to 14 shown in FIG. 1. In the present case the hinge parts are configured as a so-called "sliding compound lever" which is arranged on the lower as well as the upper horizontal bar of the casement 11 and the frame 10. The sliding compound lever shown is composed of a main arm 12 which is fixed to the lower horizontal bar of the casement 11 as shown in FIG. 1, but the protruding end of its arm is seated in an articulated manner in a slider 14. The slider 14 is provided longitudinally in the lower bar of the frame 10. Finally, the sliding compound lever also has a guide rod 13 which connects the main arm 12 to the frame 10 by means of specific connection points. The casement 11 carries out a combined pivot-displacement movement which proceeds in the direction of the arrows 15, 16 shown in FIG. 1 when it opens, and according to the arrows 15', 16' when it closes.

Figure 3:
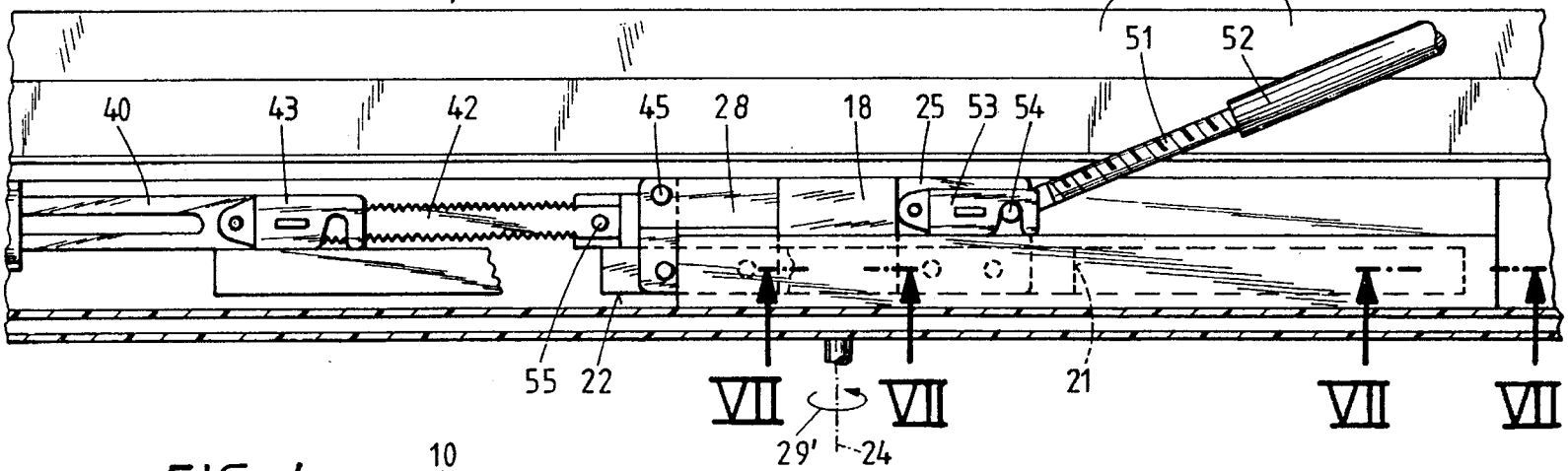
FIG. 3 illustrates the plan view of the essential parts of the device according to the invention, not showing adjacent parts, in the open position according to FIG. 1.
Figure 4:
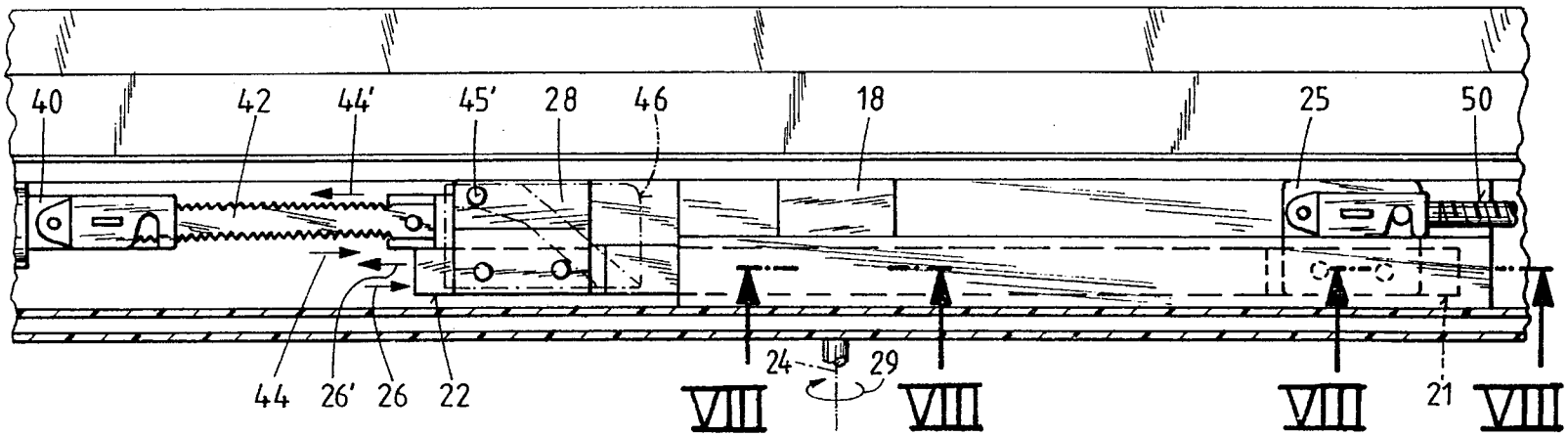
FIG. 4 illustrates a representation according to FIG. 3 showing the relationships when the device is in the closed position according to FIG. 2.
Figures 5, 6:
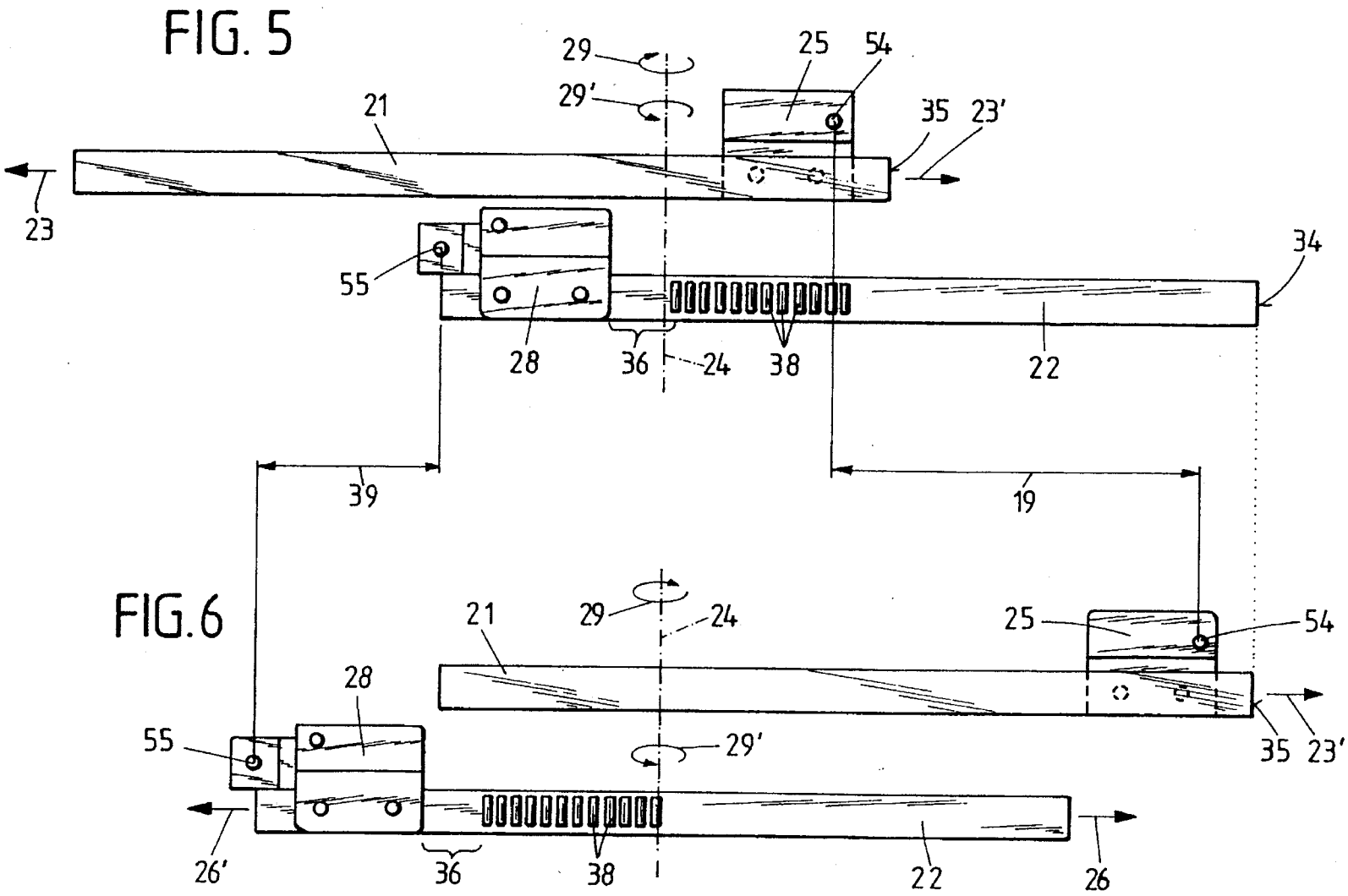
FIGS. 5 and 6 illustrate an exploded view of the position of two toothed racks of the device in the open position according to FIG. 3 or the closed position according to FIG. 4.
Figures 7, 8, 9:
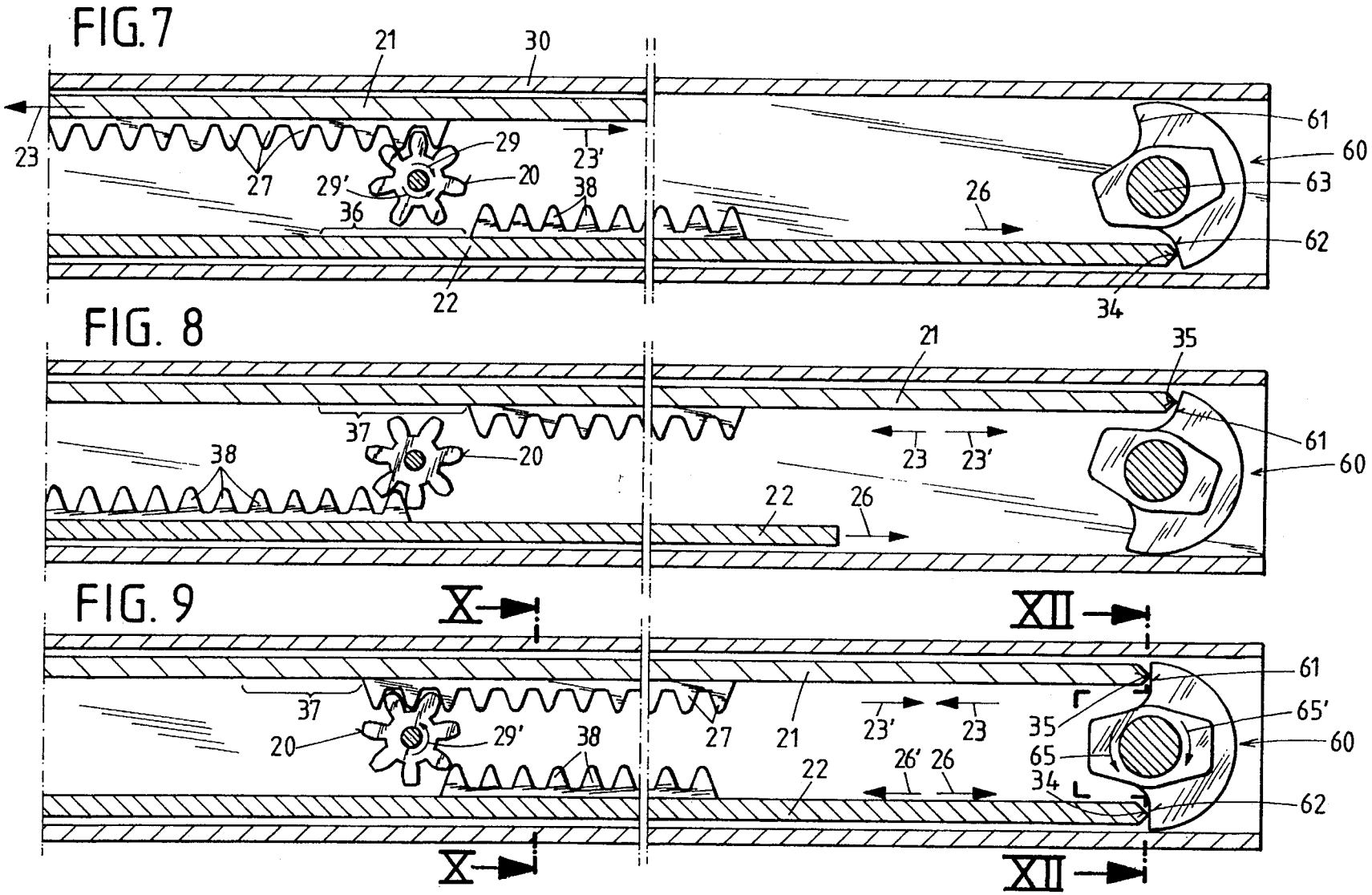
FIG. 7 illustrates an enlarged longitudinal section through a middle section and an end section of the device shown in FIG. 3 along the line of intersection VII—VII shown in FIGS. 3 and 10.
FIG. 8 illustrates a representation corresponding to FIG. 7 showing the relationships when the device is in its closed position shown in FIG. 4, according to the line of intersection VIII—VIII shown there.
FIG. 9 illustrates an intermediate position between the two final positions shown in FIGS. 7 and 8.

These combined movements 15 to 16' proceed from a first toothed rack 21 shown in FIGS. 3, 5 and 7, which is fixed to the lower bar of the frame 10 by means of a guide housing 30 into which it is received. The toothed rack 21 engages with a pinion 20 which can be rotary actuated by any actuating device, for example, manually by means of a crank handle, which is not shown in more detail, in the direction of the arrows indicating rotation 29, 29' shown in FIGS. 3 and 4. Other actuating devices can be used, for example, an electric motor drive. The axle 24 of the pinion shown by broken lines in the figures is perpendicular to the plane of the frame 17, also shown by broken lines in FIG. 10. The inside end of the axle is received into a bearing part 18 and the outer axle end protrudes out of the frame 10 and into an angle housing fixed there, and shown only in FIGS. 1 and 2. In the angle housing 66 a universal joint coupled to the outer end of the axle of the pinion is located, with the opposite end of which the crank handle engages. The plane of actuation of the crank handle is arranged in an inclined manner with respect to the plane of the frame 17 because of the angle housing 66, which makes comfortable actuation possible.

In the same guide housing 30 there is however a further, second toothed rack 22, which is connected to a closing rod 40 by means of an extension rod 42. The extension rod 42 is toothed and thus allows an adjustable length connection to the closing rod 40. The set length of the extension rod 42 is ensured by a pivoting member 43. The closure rod 40 is fixed to the frame 10 by means of a channel member 41, according to FIG. 1, and carries at least one moveable closing element, not shown in more detail, for example, in the form of a pin. The casement 11 has, on its part, the stationary closing element associated with the closing elements in the closing rod 40, which, for example, are composed of a blocking strip protruding from a base plate which is to be affixed, which will be engaged from behind by the pin located on the closing rod 40 mentioned, in the closed position of the casement. In the closed position 11' of the casement shown in FIG. 2, the latching of the casement 11' takes place. Naturally, several moveable closing elements could be arranged on the closing rod 40, which co-operate with corresponding stationary closing elements on the casement. The closing rod 40 can also run along the vertical bars of the frame 10 and be a component of a so-called central locking system.

According to the invention, the changing over of the closing rod 40 from the latched to the unlatched position of the various co-operating pairs of closing elements between the casement 11 and the frame 10 is carried out by the same actuating means, namely the pinion 20 as used for moving 15 to 16' the casement between its open position 11 and closed position 11'. Thus FIG. 1 shows not only the open position 11 of the casement but at the same time the unlatching position of the closing rod 40, while in FIG. 2 besides the closed position 11' of the casement, the latched position of the closing rod 40 is shown.

Figure 11:
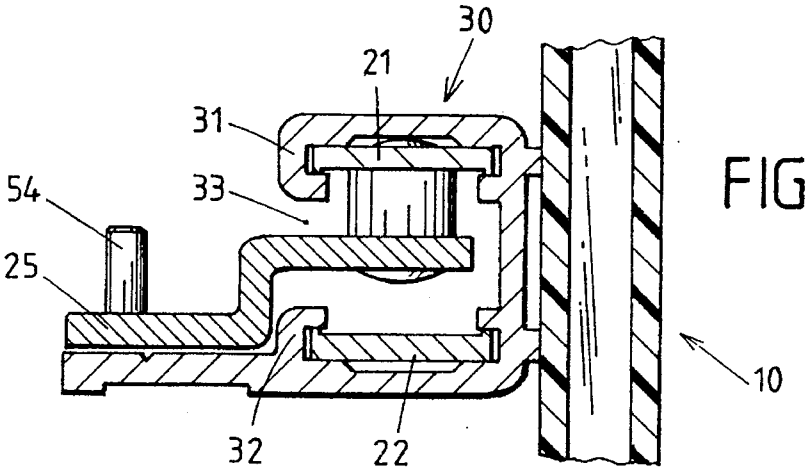
FIG. 11 illustrates a representation according to FIG. 10 of a cross-section through the device along the line of intersection XI—XI shown in FIG. 1.

In order to transfer the casement into its open position 11 according to FIGS. 1, 3 and 5, the pinion 20 is actuated in the direction of the arrow 29 indicating rotation, whereupon a longitudinal displacement 23 of the first toothed rack occurs. In FIGS. 5 and 7 the corresponding final position of the two toothed racks 21, 22 is shown, which characterizes the completely open position 11 of the casement. A connection plate 25 is connected in a fixed manner to the toothed rack 21. The guide housing 30 is C-shaped, as can be seen from FIG. 11, into the upper part of the C-shape 31 of which the toothed rack 21 is longitudinally guided. The connection plate 25 protrudes out of the longitudinal aperture from the C-shape of the guide housing 30 and there carries a bearing pin 54 for connection to one end of a connecting rod 50. The other end of the connecting rod 50 is, as shown in FIG. 1, joined to the casement 11. The length of the connecting rod 50 is adjustable and it is composed of a first rod section 51 with a circumferential thread and a sleeve-shaped second rod section 52 with an internal thread, into or out of which the first rod section 51 can be screwed to adjust the length.

To protect the coupling of the connecting rod 50 to the bearing pin 54, according to FIG. 3, a pivoting member 53 is provided on the connection plate 25.

Figure 12:
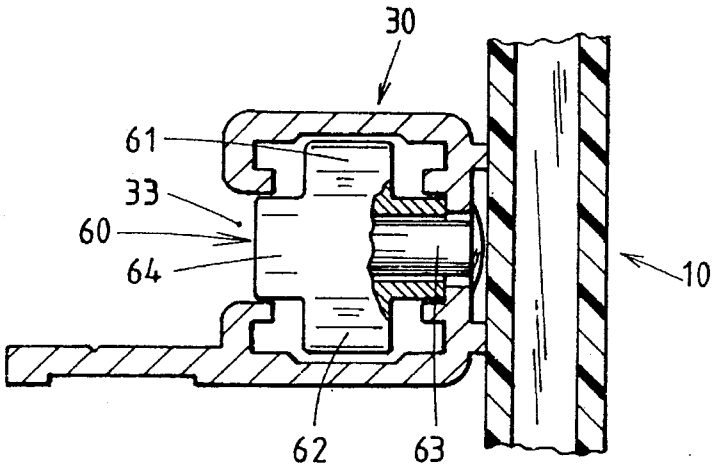
FIG. 12 illustrates a further enlarged cross-section view of the device corresponding to FIG. 10 along the projected line of intersection XII—XII shown in FIG. 9.
Figure 10:
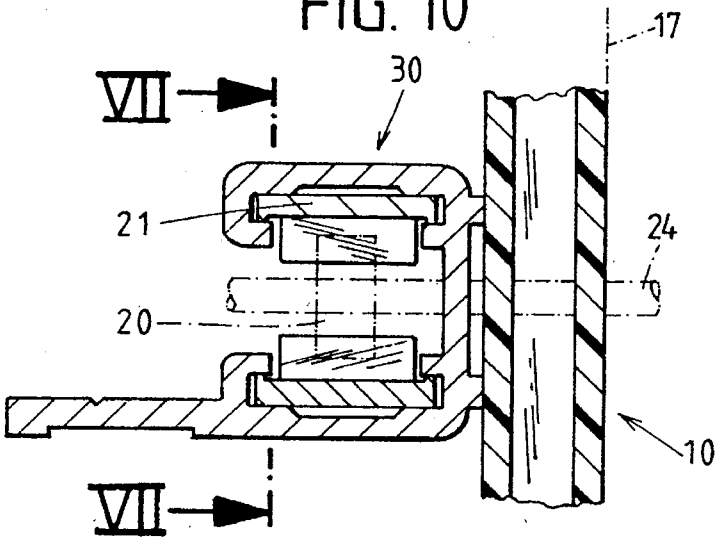
FIG. 10 illustrates a cross-section view through the enlarged representation of the device shown in FIG. 9, along the line of intersection X—X shown there.

The two toothed racks 21, 22 not only run parallel to one another, but are arranged in a common guide housing 30 one above the other, as can best be seen in FIG. 10. The second toothed rack 22 is namely received longitudinally displaceably into the area of the lower part of the C-shape 32 by the C-shape of the guide housing 30. As shown best in FIG. 5, on the end area of the toothed rack 22 there is also a connection plate 28, which protrudes laterally out of the guide 30 and has a connection point 55 for the extension rod 42 mentioned of the closing rod 40. In the open position 11 of the casement shown in FIGS. 1, 5 and 7, this second toothed rack is located in its right-hand final position. As shown in FIG. 7, this final position of the toothed rack 22 is determined in that a tooth gap 36 is located in the area of the pinion 20. The actual teeth 38 lie to the right, outside the pinion 20, as can also be seen in the exploded view shown in FIG. 5. The end 34 of the rack is then located on a special switching member 60 which is rotatably mounted in the guide housing 30 according to FIG. 12. As can be seen in FIGS. 7 and 12, the switching member 60 has two radial impact areas 61, 62, which lie in a common axial plane laid down by a bearing pin 63. One impact surface 62 cooperates with the end 34 of the rack of the lower toothed rack 22, which serves in the same way as a shoulder to control the toothed rack 22. On its end opposite to where the bearing pin 63 is attached, the switching member 60 has a shank 64 which, as shown in FIG. 12, can be supported in the longitudinal aperture 33 of the C-shape of the guide housing 30.

In order to close the casement 11 in the direction of the arrows 15', 16' shown in FIG. 1, the pinion 20 is actuated in the direction of the arrow 29' indicating return rotary movement, shown in FIGS. 3 and 7. Because of the tooth gap 36 mentioned, this at first can have no effect on the second toothed rack 22, however, the pinion 20 drives the first toothed rack 21 back in the direction of the arrow 23' shown in FIGS. 5 and 7. This first toothed rack 21 is engaged with the pinion 20 by means of its teeth 27 as shown in FIG. 7. An intermediate position of the toothed rack 21 is then reached, which is shown in FIG. 9.

According to FIG. 9, the end of the rack 35 of the toothed rack 21 arrives at the upper impact surface 61 of the switching member 60. When the pinion 20 is rotated further 29', as a result the end of the rack 35 carries the switching member 60 along with it and pivots it in the direction of the arrow 65' shown in FIG. 9. Because of this the lower impact surface 62 also pivots and presses the end of the rack 34 of the second toothed rack 22 lying thereon back again in the direction of the arrow 26'. The effect of this however, is that the teeth 38 of the toothed rack 22 gradually reach the area of the pinion 20 and finally there is an engagement between the toothed rack 22 and the pinion 20. The switching member 60 has then fulfilled its function and coupled the toothed rack 22 to the pinion 20. The final phase of the uncoupling movement 23' by 21 is directionally transferred by the switching member 60 and converted into a coupling movement 26' by 22.

When the pinion 20 is rotated further 29', the first toothed rack 21 finally reaches the other final position shown in FIG. 8, whereupon the return displacement 23' is automatically terminated, in that a tooth gap 37 has moved into the area of the pinion 20. Now the teeth 27 of the toothed rack 21 are located to the right of the pinion and the end of the rack 35 reaches its final position shown in FIGS. 6 and 8. The first toothed rack 21 is uncoupled from the drive pinion 20. The switching member 60 is brought into an inclined position opposite to that of the previously described pivoted position shown in FIG. 7 by means of the impact surface 61. The connection plate 25 of the first toothed rack 21 is located in the right hand final position, as a result of which the connecting rod 50 of the casement engaging with the bearing pin 54 arrives in its closed position 11' shown in FIG. 2.

As the second toothed rack 22 is coupled to the pinion 20 by means of its teeth 38, it is displaced in the direction of the arrow 26'. In this way the closing rod 40 is displaced in the direction of the arrow 44' indicating movement, by means of the extension rod 42 seated on the associated connection plate 28. The closing elements mentioned, located on the closing rod 40 and not shown in more detail, then arrive in a latching position in which the casement 11 is held in a fixed manner in the frame 10 by means of the opposing closing elements located there. The second toothed rack 22 has now also reached its final position according to FIG. 6. The resulting relationships can be seen from FIGS. 4 and 6.

As shown by a comparison of the two final positions shown in FIGS. 5 and 6, the first toothed rack 21 has been displaced by a large distance of travel 19, used for the closing movement 15', 16' of the casement. On the other hand, the second toothed rack 22 has been displaced by a comparatively shorter distance of travel 39, used for the positioning 44' of the closing rod 40. The lengths of these dual sided distances of travel 19, 39 and the point in time for the coupling or uncoupling of the two toothed racks 21, 22 to the pinion 20 depends upon the dimensioning of the racks 21, 22, the tooth gaps 37, 36 and the arrangement of the switching member 60 in the guide 30. In certain 30 areas there can also be an overlapping of the engaging of the two toothed racks 21, 22 to the common pinion 20. Because of the automatic change-over 65' or 65, of the switching member 60 according to FIG. 9, it is in any case ensured that at least one of the two toothed racks 21 or 22 is coupled to the pinion.

Proceeding from FIGS. 2, 4 and 6, in order to open the casement 11' again in the direction of the arrows 15, 16 indicating movement, the rotary actuation of the pinion in the direction of the arrow 29 shown in FIG. 6 simply has to be carried out. According to FIG. 8 the teeth 38 of the lower toothed rack 22 are engaged with the pinion 20 and the longitudinal displacement in the direction of the arrow 26 takes place. This results in a displacement 44 of the closing rod 40 connected thereto, which transfers the moveable closing elements in the frame 10 into their unlatching position. The effect of this longitudinal displacement 26 is finally, as shown by the intermediate position shown in FIG. 9, that the end of the rack 34 meets the lower impact surface 62 of the switching member 60 and rotates it in the direction of the arrow 65 indicating pivoting already mentioned. Because of this the already leading toothed rack 21, in contact with the upper impact surface 61 by means of its end of the rack 35, according to FIG. 8, is longitudinally displaced in the direction of the arrow 23. The leading tooth gap 37 located on the toothed pinion 20, shown in FIG. 8, is thereby displaced to the left and the pinion 20 again engages with the teeth 22 of the toothed rack 21. In this way the operating cycle of the device is terminated.

As shown, the switching member 60 has the function of transferring the displacement 23', 26 of one toothed rack 21, 22 into a corresponding opposite displacement 26', 23 of the other toothed rack 22 or 21. It would of course also be possible to transfer this displacement directly, without a switching member, between the toothed racks by means of shoulders on the two toothed racks 21, 22, which then perform another controlling movement in the same direction. As in the present case the two toothed racks 21, 22 lie on top of one another, a particularly compact and space-saving construction of the device is obtained.

As shown in FIG. 1, between the second toothed rack 22 or the extension rod 42 attached thereto, and the casement 11, a pair of radial cams 45, 46 is arranged which in the final phase cooperates with the closing movement 15, 16' as well as the opening movement 15, 16 of the casement. This pair of radial cams 45, 46 has the task of pressing the casement against the frame 10 when the casement is transferred to the closed position 11'. This pair of radial cams is composed of a pin 45 which sits on the connection plate 28 according to FIGS. 3 and 5, which is thus a control member which can be displaced with the toothed rack 22 in the direction of the arrows 26, 26'. The control member 45 has a round profile. On the casement 11, on the other hand, the complementary, stationary opposing control member 46 is located. The casement-side opposing control member 46 includes a control channel 47 which, as shown best by FIG. 13, is provided with shaped channel sides 48, 49 and an assembly plate 56 which makes possible the attachment of the opposing control member 46 to the lower bar of the casement 11. The control member 45 and the opposing control member 46 are not only defined shaped but are also arranged in a specified position with respect to the toothed rack 22 or the casement 11, in order to carry out the following particular controlling movements.

In FIG. 13 the control pin 45 is introduced into the control channel 47 by means of the return displacement 26' of the toothed rack 22, determined by the closing movement 15', 16' of the casement, in the direction of the arrow 58 shown in FIG. 13 and is located between the two channel sides 48, 49. If the return rotation 29' of the pinion 20 is now interrupted, the casement is kept in the position 11" shown in FIG. 13 by means of the two control members 45, 46. The casement 11" is located in the already mentioned "ventilation gap 30 position" as shown in FIG. 13 by broken lines, where the casement 11" is still at a slight distance 57 away from the frame 10.

If a smaller gap 57 is desired, the control pin 45 simply has to be return displaced by further rotation 29 of the pinion 20. Then, the control pin 45 runs deeper into the control channel 47 and presses against the inside channel side 49. In this way the casement 11" is pressed against the frame 10 in the direction of the arrow 59 indicating force, shown in FIG. 13. This channel side is shaped so that finally in the end position 45' indicated by broken lines in FIG. 13, there is also a latched position with this pair of radial cams 45, 46 as with the closing elements cooperating by means of the closing rod 40. In FIG. 13 the control pin 45' engages behind a flattened end piece of the channel 10 side 49.

When the casement is opened from its closed position 11' shown in FIG. 4, as already mentioned, the pinion is actuated in the direction of the arrow 29 indicating rotary movement, which produces the longitudinal displacement shown by the arrow 26 of the second toothed rack 22. As a result the control pin is also displaced back out of its final position 45' shown in FIG. 13 and impacts against the outer channel side 48. Because of this the casement is pushed, by means of the opposing control member 46 located thereupon, away from the stationary frame 10 and arrives next in the ventilation gap position 11" shown in FIG. 13. Up until this point the first toothed rack 21 still does not need to be effective, as it is located in the uncoupled position with respect to the pinion shown in FIG. 8 and already described.

The conclusive opening movement 15, 16 of the casement into the open position according to FIG. 1, controlled by means of the first toothed rack 21, first begins when the pinion is further rotated in the direction of the arrow 29 indicating rotation, shown in FIG. 4. A change-over occurs at the intermediate position shown in FIG. 9, where the first toothed rack 21 is coupled to the pinion 20 by the uncoupling movement 26 of the second toothed rack 22 in the direction of the arrow 23 shown in FIG. 9. The moveable closing elements connected to the closing rod 40 are brought, by means of the toothed rack 22, into their ineffective unlatching position, where they release stationary closing elements located on the casement. The described opening movement 15, 16 of the casement 11 in the direction shown in FIG. 1, by means of the toothed rack 21, can now begin.

While the foregoing description and drawings represent the preferred embodiments of the present invention, it will be obvious to those skilled in the art that various changes and modifications may be made therein without departing from the true spirit and scope of the present invention.

What is claimed is:

1. In a device for opening and closing a window, a door, or the like having a stationary frame and having a casement moveable between a closed position and an open position, which is connected to the frame by at least one hinge part, having a toothed rack, longitudinally displaceable by a rotary operated actuating means which is connected to the casement by a hinge rod and wherein the hinge rod transfers longitudinal displacement of the toothed rack into movement of the casement, and having at least one pair of closing elements between the casement and the frame which is composed of a moveable and a stationary closing element, and acts to ensure said closed position of the casement, the moveable closing element of which can be changed over, by a closing rod, between a latched position holding the casement against the frame and an unlatched position releasing the casement, the improvement comprising: that said toothed rack is a first toothed rack cooperating with the casement, and that a second toothed rack is arranged in the frame, which is connected to the closing rod for the moveable closing element located in the frame, both toothed racks being longitudinally capable of being displaceable by the same actuating means, only one of said two toothed racks being ordinarily coupled to the actuating means, while the other is uncoupled and stationary, and wherein the ordinarily coupled toothed rack uncouples itself automatically from the actuating means after a predetermined distance of travel and the final phase of its longitudinal displacement serves to couple the other toothed rack to the actuating means.

2. The device according to claim 1, wherein the predetermined distance travelled by the toothed rack is determined by a tooth space in the toothed rack opposite the actuating means.

3. The device according to claim 1, wherein both toothed racks each have a shoulder and between these shoulders the final phase of movement of the one uncoupling toothed rack is transferred in order to couple the other toothed rack to the actuating means.

4. The device according to claim 3, wherein the shoulders are located on the ends of the two toothed racks.

5. The device according to claim 1, wherein the final phase of movement is indirectly transferred, by means of a switching member between the two toothed racks.

6. The device according to claim 5, wherein the shoulder of the uncoupling toothed rack impacts on a switching member and carries it along and the carried switching member impacts with a shoulder of the other toothed rack and transfers this into a coupling position opposite said actuating means.

7. The device according to claim 5, wherein the switching member changes over the direction of the displacement between the two toothed racks.

8. The device according to claim 7, wherein the orientation of the longitudinal displacement between the two toothed racks changes over by the switching member in that a displacement in the final phase of the uncoupling toothed rack directed towards the right is converted into a displacement directed towards the left of the other toothed rack to be coupled, and vice-versa.

9. The device according to claim 8, wherein the switching member is rotatably mounted on the frame and is provided with two radial impact surfaces which cooperate with the shoulders of the two toothed racks.

10. The device according to claim 9, wherein both impact surfaces lie in a common axial plane which is defined by the pivot bearing of the switching member.

11. The device according to claim 1, wherein the two toothed racks run parallel to one another.

12. The device according to claim 11, wherein the two toothed racks are arranged one on top of the other, a common pinion of the actuating means being disposed between them.

13. The device according to claim 1, wherein the two toothed racks are received in a common guide housing by longitudinal displacement and the guide housing is fixed onto the frame.

14. The device according to claim 1, wherein between the casement on the one hand and the second toothed rack or the closing rod proceeding therefrom, connected to the moveable closing elements on the other hand at least one pair of radial cams is arranged, which, when the casement moves, before reaching, or after leaving the closed position serves to press the casement against or push it away from the frame.

15. The device according to claim 14, wherein the pair of radial cams is composed respectively of a control member which can be displaced with the second toothed rack, and an opposing control member resting on the casement and the co-displaceable control member is arranged on the connection between the second toothed rack and the closing rod.

16. The device according to claim 15, wherein the co-displaceable control member is composed of a control pin while the stationary opposing control member is composed of a control channel with shaped channel sides for receiving the control pin.

17. The device according to claim 1, wherein the length of the hinge rod between the casement and the first toothed rack is adjustable.

18. The device according to claim 17, wherein the coupling point of the hinge rod with the first toothed rack is protected by a pivoting member.

19. A device for opening and closing a window, a door or the like comprising:

a stationary frame;

a casement moveable between a closed position and an open position, said casement being connected to the frame by at least one hinge part;

a first toothed rack, longitudinally displaceable by a rotary operated actuate means which is connected to the casement by a hinge rod and wherein the hinge rod transfers longitudinal displacement of the toothed rack into movement of the casement;

at least one pair of closing elements between the casement and the frame which is composed of a moveable and a stationary closing element and acts to ensure said closed position of the casement, the moveable closing element of which can be changed over by a closing rod between a latched position holding the casement against the frame and an unlatched position releasing the casement;

a second toothed rack being arranged in the frame which is connected to the closing rod for the moveable closing element located in the frame, both first and second toothed racks being longitudinally capable of being displaceable by the same actuating means, only one of said two toothed racks being ordinarily coupled to the actuating means while the other is uncoupled and stationary; and wherein said ordinarily coupled toothed rack uncouples itself automatically from the actuating means after a predetermined distance of travel and the final phase of its longitudinal displacement serves to couple the other toothed rack to the actuating means.

* * * * *